US005611204A

United States Patent [19]

Radovanovic et al.

[11] Patent Number: 5,611,204

[45] Date of Patent: Mar. 18, 1997

[54] EGR AND BLOW-BY FLOW SYSTEM FOR HIGHLY TURBOCHARGED DIESEL ENGINES

[75] Inventors: Rod Radovanovic; A. S. Ghuman; Gregory H. Henderson; Angela R. May, all of Columbus, Ind.

[73] Assignee: Cummins Engine Company, Inc., Columbus, Ind.

[21] Appl. No.: 671,072

[22] Filed: Jun. 27, 1996

Related U.S. Application Data

[63] Continuation of Ser. No. 404,059, Mar. 14, 1995, abandoned, which is a continuation-in-part of Ser. No. 152,453, Nov. 12, 1993, abandoned.

[51] Int. Cl.[6] ..... F02M 25/07

[52] U.S. Cl. ..... 60/605.2; 123/574; 417/151; 417/159

[58] Field of Search ..... 60/605.2; 123/574; 417/151, 159, 194, 196

[56] References Cited

U.S. PATENT DOCUMENTS

| | | | |
|---|---|---|---|
| 2,270,546 | 1/1942 | Neuland . | |
| 2,297,910 | 10/1942 | Neuland . | |
| 3,149,454 | 9/1964 | Hahn . | |
| 3,371,618 | 3/1968 | Chambers | 417/196 |
| 3,877,447 | 4/1975 | Bader . | |
| 3,925,989 | 12/1975 | Pustelnik . | |
| 3,996,748 | 12/1976 | Melchior . | |
| 4,034,028 | 7/1977 | Tsoi-Hei Ma . | |
| 4,142,493 | 3/1979 | Schira et al. . | |
| 4,157,081 | 6/1979 | Wake et al. . | |
| 4,174,027 | 11/1979 | Nakazumi . | |
| 4,196,706 | 4/1980 | Kohama . | |
| 4,206,606 | 6/1980 | Yamada . | |
| 4,217,869 | 8/1980 | Masaki . | |
| 4,224,912 | 9/1980 | Tanaka . | |
| 4,276,865 | 7/1981 | Hamai . | |
| 4,289,107 | 9/1981 | Peters . | |
| 4,363,310 | 12/1982 | Thurston . | |
| 4,426,848 | 1/1984 | Stachowicz . | |
| 4,442,820 | 4/1984 | Ina et al. . | |
| 4,452,217 | 6/1984 | Kawamura et al. . | |
| 4,462,379 | 7/1984 | Tsuge et al. . | |
| 4,466,415 | 8/1984 | Piesche . | |

(List continued on next page.)

FOREIGN PATENT DOCUMENTS

| | | |
|---|---|---|
| 0080327 | 1/1983 | European Pat. Off. . |
| 2271394 | 5/1974 | France . |
| 3831080 | 4/1989 | Germany . |
| 4038918 | 6/1992 | Germany . |
| 63-189664 | 8/1988 | Japan . |
| 3-37318 | 8/1991 | Japan . |
| 4-103867 | 4/1992 | Japan . |
| 422861 | 4/1974 | U.S.S.R. . |
| 2250801 | 6/1992 | United Kingdom . |

OTHER PUBLICATIONS

American Institute of Aeronautics and Astronautics, Paper No. AIAA–88–0188, entitled "Parameter Effects on Mixer–Ejector Pumping Performance", Stanley A. Skebe, Duane C. McCormick, and Walter M. Presz, Jr.

*Primary Examiner*—Michael Koczo
*Attorney, Agent, or Firm*—Woodard, Emhardt, Naughton Moriarty & McNett

[57] ABSTRACT

A gas flow network in combination with a highly turbocharged diesel engine for the blending of either EGR gas or blow-by gas from the crankcase vent with fresh charge air is disclosed. In the diesel engine assembly which incorporates the flow network for EGR gas, a venturi conduit and control valve combination is positioned between tile intake manifold and aftercooler and is connected to a flow line carrying the EGR gas. When the turbocharged diesel engine assembly is configured with a flow path for blow-by gas, the venturi and control valve combination is positioned between the intake manifold and aftercooler and is connected to a flow line carrying blow-by gas. These systems utilize a low static pressure at the narrow throat of the venturi so as to induce the flow of EGR gas or blow-by gas into the fresh charge air, the flow being controlled by the state of the control valve.

6 Claims, 5 Drawing Sheets

U.S. PATENT DOCUMENTS 4,474,008 10/1984 Sakurai et al. .
4,478,199 10/1984 Narasaka et al. .
4,479,478 10/1984 Arnaud .
4,501,234 2/1985 Toki et al. .
4,548,185 10/1985 Pozniak .
4,669,442 6/1987 Nakamura et al. .
4,773,379 9/1988 Hashimoto et al. .
4,924,668 5/1990 Panten et al. .
5,061,406 10/1991 Cheng .
5,094,218 3/1992 Everingham et al. .
5,137,004 8/1992 Takahata et al. .
5,150,680 9/1992 Nishimura .
5,203,311 4/1993 Hitomi et al. .
5,205,265 4/1993 Kashiyama et al. .
5,333,456 8/1994 Bollinger .

EGR AND BLOW-BY FLOW SYSTEM FOR HIGHLY TURBOCHARGED DIESEL ENGINES

REFERENCE TO RELATED APPLICATIONS

This application is a continuation, of application Ser. No. 08/404,059, filed Mar. 14, 1995, now abandoned, which is a continuation-in-part patent application of parent application Ser. No. 08/152,453, filed Nov. 12, 1993, now abandoned.

BACKGROUND OF THE INVENTION

The present invention relates in general to the routing and flow path for recirculating exhaust gas (EGR) and the routing and flow path for blow-by (crankcase vent) gas. More specifically the present invention relates to the use of a control valve in cooperation with a venturi design in the flow path to introduce exhaust gases into the intake manifold in a mix with fresh charge air from the turbocharger.

At the present time blow-by (crankcase vent) gas of medium and heavy duty diesel engines is typically vented to the atmosphere. However, it is expected that in the near future environmental/emissions legislation will mandate that this gas be recirculated into the fresh charge air. The expected legislation will likely be similar if not the same as what is now in effect for gasoline engines and light duty diesel engines.

In anticipation of such legislation, some thought must be given to where and how such blow-by gas can be integrated into the air/gas flow network. One option, routing the blow-by gas in front of the compressor of the turbocharger is not desirable due to fouling of the wheel and aftercooler by oily deposits and other particulate matter.

In one embodiment of the present invention a venturi, with a cooperating control valve, is placed in the flow path downstream of tile aftercooler so as to induce the flow of blow-by gas into the fresh charge air. The induced flow is created by having a low enough static pressure at the throat of the venturi. Several venturi designs are disclosed, each of which is suitable for the present invention. In a related embodiment of the present invention, the venturi/control valve combination is placed in the flow path downstream of the aftercooler so as to induce the flow of EGR into the fresh charge air.

One application proposed for EGR, as conceived by the present inventors, is to use EGR as a means of reducing $NO_x$ in medium and heavy duty turbocharged diesel engines. For such engines EGR should be introduced at various speed and load conditions to be effective in $NO_x$ reduction due to the type of transient testing required by EPA and CARB.

It is generally recognized that the production of noxious oxides of nitrogen ($NO_x$) which pollute the atmosphere are undesireable and in many cases are controlled by limits established by local, state and federal governmental regulations. The presence of $NO_x$ in the exhaust of temperature causes an increase in the amount of $NO_x$ present internal combustion engines is determined by combustion temperature and pressure. An increase in combustion in the engine exhaust. It is therefore desireable to control the combustion temperature in order to limit the amount of $NO_x$ present in the exhaust of an internal combustion engine.

One possibility for limiting or controlling the combustion temperature is to recirculate a portion of the exhaust gas (EGR) back to the engine air intake. Since the exhaust gas has a higher specific heat, the combustion mixture will burn at a lower temperature. The lower combustion temperature will, in turn, reduce the amounts of $NO_x$ produced during combustion.

While $NO_x$ formation is known to decrease as the EGR flow increases, it is also known that this is accompanied by a deterioration of engine performance including, but limited to, an increase in engine roughness and a decrease of power output within increasing EGR. Therefore, one factor limiting the magnitude of EGR is the magnitude of EGR-induced performance deterioration or roughness that can be tolerated before vehicle driveability becomes unacceptable. Furthermore, EGR should not be turned on during load transience, as this causes "incomplete combustion" which results in black smoke from the engine exhaust. It is also usually desireable that EGR be turned off during hard acceleration so that the engine may operate at maximum power output.

Determining the proper amount of EGR under varying engine operating conditions is a complex task. Most prior art control systems utilize at least two sensed engine parameters as inputs to the control system which controls the EGR. For example, U.S. Pat. No. 4,224,912 issued to Tanaka utilizes both engine speed and the amount of intake air as control variables. U.S. Pat. No. 4,142,493 issued to Schira et al. utilizes either engine speed and manifold absolute pressure or engine speed and throttle position. U.S. Pat. No. 4,174,027 issued to Nakazumi utilizes both clutch-actuation detection and throttle valve-opening detection as input variables to the control system. These methods all require the monitoring of several engine parameters, which may have a significant cost impact if the monitored signals are readily available within the engine. It is, therefore, desirable to control the EGR with a single monitored engine parameter as input to the control system in order to reduce the complexity of the control system, thereby improving cost efficiency and system reliability.

EGR control systems need to be carefully reviewed because many designs cannot be used with diesel engines. Diesel engines differ from spark ignition engines in a number of important ways, one being that the diesel engine does not include a valved, or throttled, intake manifold into which the combustion air is induced through a throttle and valve. Accordingly, the vacuum pressure existing in a diesel engine intake duct is slight at most. The source of vacuum pressure provided by the intake manifold of a spark ignition engine is, therefore, not available in a diesel engine. Hence, any prior art control system utilizing the vacuum pressure as an input to the control system will not work with a diesel engine.

In a diesel engine, the engine speed under a given load is controlled by the quantity of fuel injected into tile engine combustion chambers and accordingly the "throttle" of the diesel engine is considered to be a manually operated foot pedal connected by a linkage to a fuel pump for supplying the engine fuel injectors. The foot operated pedal is actuated to govern the quantity of fuel delivered by the fuel pump to the combustion chambers of the engine and thus controls the engine speed under a given load. Since the quantity of fuel introduced into the combustion chamber varies, the production of $NO_x$ varies as a function of the throttle setting. This being the case, it is theoretically possible to control EGR in a diesel engine using only the throttle position as an input to tile control system.

The present invention is therefore directed toward providing an EGR control system which utilizes only throttle position as an input to the control system. Such a control system could then be used with a diesel engine.

In medium and heavy duty turbocharged diesel engines the intake manifold pressure (boost) is typically higher than exhaust pressure in front of the turbine of the turbocharger. Therefore, one choice would be to route the exhaust gas to the inlet of the compressor of the turbocharger. However, this is not a good practice due to the fouling of the compressor wheel and possibly the aftercooler due to particulate in tile exhaust gas. Also, the compressor wheel which is typically made of aluminum cannot tolerate the high temperature of the incoming mixture of fresh air and exhaust gas due to the very high temperature of the compressed mixture at the point of leaving the wheel.

In another related embodiment of the present invention a venturi, with a cooperating control valve, is placed in the fresh charge air flow line between the compressor and aftercooler and is connected to an exhaust gas flow line whose input side is connected between the exhaust manifold and the turbine. Static pressure at the throat of the venturi is sufficiently low so as to induce the flow of exhaust gas into the flow of fresh charge air.

With regard to the various embodiments of the present invention, the following list of U.S. patent references is believed to provide a representative sampling of the types of flow paths and flow arrangements which have been conceived of in order to deal with blow-by gas and recirculating exhaust gas.

| U.S. Pat. No. | Patentee | Date Issued |
|---|---|---|
| 3,877,477 | Bader | Apr. 14, 1975 |
| 3,925,989 | Pustelnik | Dec. 16, 1975 |
| 4,034,028 | Tsoi-Hei Ma | July 5, 1977 |
| 4,206,606 | Yamada | Jun. 10, 1980 |
| 4,363,310 | Thurston | Dec. 14, 1982 |
| 4,462,379 | Tsuge et al. | Jul. 31, 1984 |
| 4,478,199 | Narasaka et al. | Oct. 23, 1984 |
| 4,479,478 | Arnaud | Oct. 30, 1984 |
| 4,501,234 | Toki et al. | Feb. 26, 1985 |
| 4,669,442 | Nakamura et al. | Jun. 2, 1987 |
| 4,773,379 | Hashimoto et al. | Sep. 27, 1988 |
| 4,924,668 | Panten et al. | May 15, 1990 |
| 5,061,406 | Cheng | Oct. 29, 1991 |
| 5,094,218 | Everingham et al. | Mar. 10, 1992 |
| 5,203,311 | Hitomi et al. | Apr. 20, 1993 |

While each of the foregoing references describe certain flow paths and flow arrangements, none are believed to include all of the novel features of the present invention.

SUMMARY OF THE INVENTION

A combination of a turbocharged diesel engine assembly and a venturi for blending outlet gas flow from the diesel engine with fresh charge air according to one embodiment of the present invention comprises a diesel engine, a turbocharger, a gas flow outlet from the diesel engine and a fresh charge air flow path from the turbocharger to the diesel engine so as to deliver fresh charge air from the turbocharger to the diesel engine and a venturi placed in the fresh charge air flow path after the turbocharger and being connected via a control valve in flow communication with the gas flow outlet whereby gas flow exiting from the gas flow outlet is blended with fresh charge air due to a low static pressure created by the venturi.

One object of the present invention is to provide an improved turbocharged diesel engine assembly which includes a venturi for blending outlet gas flow and fresh charge air.

Related objects and advantages of the present invention will be apparent from the following description.

DESCRIPTION OF THE PREFERRED EMBODIMENT

Figure 1:
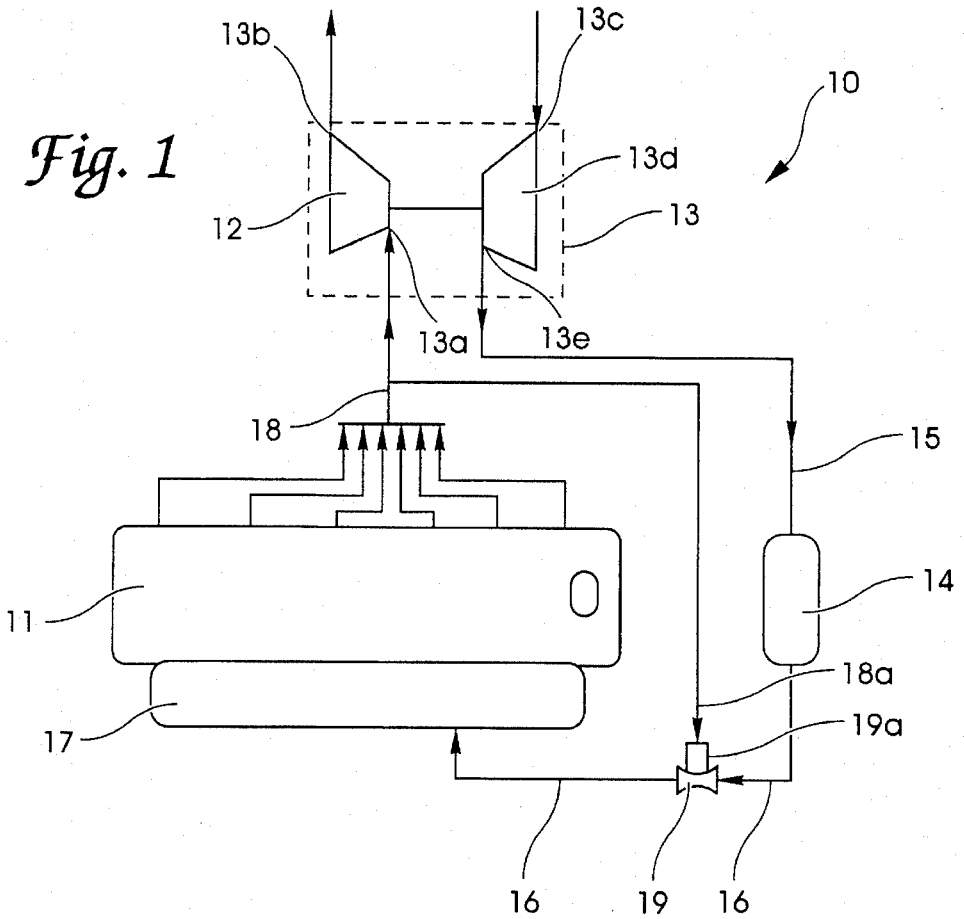
FIG. 1 is a schematic illustration of a turbocharged diesel engine assembly including a venturi conduit in the air flow path according to a typical embodiment of the present invention.

For the purposes of promoting an understanding of the principles of the invention, reference will now be made to the embodiment illustrated in the drawings and specific language will be used to describe tile same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is illustrated a schematic representation of an air/exhaust flow network 10 for a highly turbocharged diesel engine 11. In this schematic representation the exhaust gas from the cylinders (exhaust manifold) is directed to turbine 12 of the turbocharger 13. In the context of this description and for the purposes of this disclosure, the illustration of FIG. 1 is actually a turbocharged diesel engine assembly which includes the actual engine 11 as well as separate turbocharger 13, aftercooler 14, various flow lines and components.

Turbocharger 13 is of a conventional construction and operation. Its structure includes exhaust gas intake 13*a*, exhaust gas outlet 13*b*, air intake 13*c*, compressor 13*d* and compressed air outlet 13*e*. Flow line 15 routes compressed air (fresh charge air) to the aftercooler 14 and from there via flow line 16 to the intake manifold 17 of engine 11. Flow line 18 connects the exhaust manifold to the turbine and flow line 18*a* is connected to flow line 18 as illustrated. Disposed in flow line 16 is venturi conduit 19 and attached directly to the throat of the venturi is a control valve 19*a*. Control valve 19*a* is placed in flow line 18*a* and is designed to deliver recirculating engine gas (EGR)to venturi 19 by means of the low static pressure of venturi 19. Venturi conduit 19 may be configured with a fixed or variable throat area and it creates a low enough static pressure so as to induce the flow of EGR gas from flow line 18*a* into the flow of fresh charge air from aftercooler 14.

Figure 2:
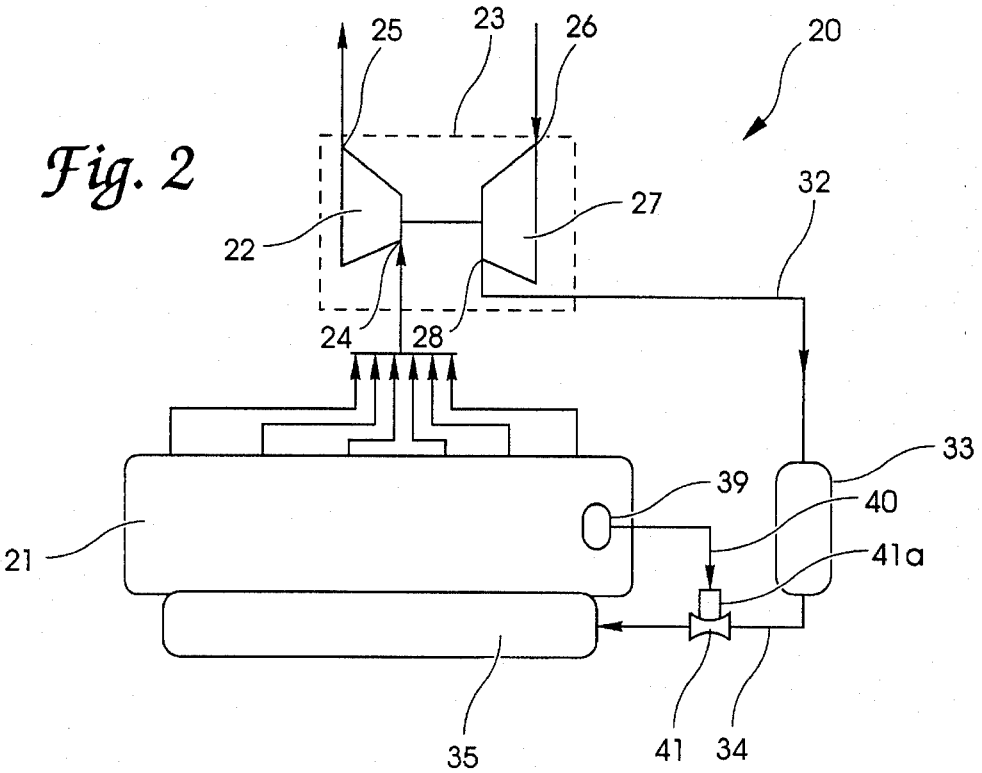
FIG. 2 is a schematic illustration of a turbocharged diesel engine assembly including a venturi conduit in the air flow path according to a typical embodiment of the present invention.

Referring to FIG. 2 there is illustrated a schematic representation of an air/exhaust flow network 20 for a highly turbocharged diesel engine 21. In this schematic representation, similar to the FIG. 1 system, the exhaust gas from the cylinders (exhaust manifold) are directed to turbine 22 of turbocharger 23. In the context of this description the illustration of FIG. 2 is actually a turbocharged diesel engine assembly which includes the actual engine as well as a separate turbocharger and other flow lines and components.

Turbocharger 23 is of a conventional construction and operation. Its structure includes exhaust gas intake 24, exhaust gas outlet 25, air intake 26, compressor 27 and compressed air outlet 28. Flow line 32 routes the compressed air (fresh charge air) to the aftercooler 33 and from there via flow line 34 to the intake manifold 35 of engine 21.

The crankcase vent 39 delivers blow-by gas via flow line 40 to control valve 41*a* which is attached directly to the throat of venturi conduit 41 which is disposed within flow line 34. Venturi conduit 41 may be configured with a fixed or variable throat area and it creates a low enough static pressure so as to induce the flow of blow-by gas from flow line 40 into the flow of fresh charge air from aftercooler. 33.

Control valves 19*a* and 41*a* have a similar construction (see FIG. 10) and as indicated each is attached directly to the throat area of the corresponding venturi conduit. By attaching the control valve directly to the venturi two important advantages are realized. First, the valve temperature is reduced by mounting it to a relatively cool surface (air intake). Secondly, this mounting location is the optimal place for controlling the exhaust gas (or blow-by gas) delivery. The responsiveness of the control valve 19*a*, 41*a* between opened and closed conditions is critical and the direct attachment eliminates or at least dramatically reduces any line losses or delays. If the control valve is upstream from the venturi then the line between the two results in additional gas delivery to the venturi even after the control valve is closed.

Figure 3:
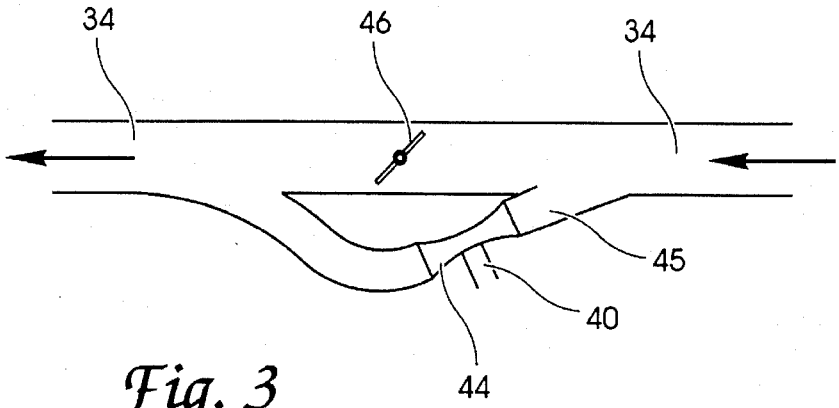
FIG. 3 is a diagrammatic illustration of an alternative configuration for placement of the FIG. 2 venturi conduit in the flow path.

Referring to FIG. 3 one venturi design suitable for the present invention is diagrammatically illustrated. Venturi 44 which is suitable for use as either venturi 19 or venturi 41 is disposed in a branch line 45 which splits off of flow line 34 (or flow line 16 in FIG. 1). Branch line 45 which incorporates the venturi 44 then rejoins flow line 34 (16) downstream of the venturi 44.

Figure 4:
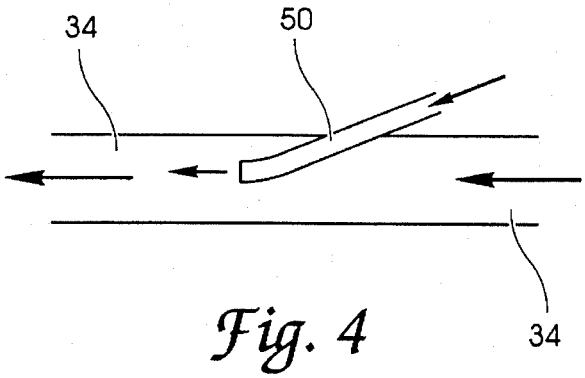
FIG. 4 is a diagrammatic illustration of a flow tube and flow line arrangement which results in a venturi effect and which is suitable for use in either the FIG. 1 or FIG. 2 assemblies.

Using the FIG. 2 system as the reference system for FIGS. 3 and 4, flow line 40 which delivers the blow-by gas to the low pressure throat of the venturi 44 is shown as intersecting the sidewall of venturi 44. In this embodiment only a smaller portion of the entire fresh charge air in flow line 34 is split into branch line 45 and flows through venturi 44. Butterfly valve 46 disposed in flow line 34 is used to control the amount of gas flowing to venturi 44. By the arrangement of FIG. 3 flow losses are reduced and there is still a low enough static pressure at the venturi throat to induce in flow of blow-by gas (FIG. 2) or EGR gas (FIG. 1).

Referring to FIG. 4 another design suitable for the present invention (including the FIG. 1 and FIG. 2 systems) is diagrammatically illustrated. The arrangement of FIG. 4 represents a relatively simple way to introduce EGR gas into the flow of fresh charge air in flow line 16 (FIG. 1) or blow-by gas into the flow of fresh charge air in flow line 34 (FIG. 2). By means of a small pipe 50 inserted into flow line 34 and directed in a downstream direction, blow-by gas is drawn into the flow of fresh charge air. While pipe 50 acts as a type of ejector, flow is still the result of pressure differences. The pressure drop which is part of the flow of the fresh charge air creates enough of a pressure drop relative to the pressure in pipe 50 for a suction action to occur and for the blow-by gas to be drawn from the small pipe 50 into flow line 34. The FIG. 4 arrangement would be used without any control valve such as valve 41*a*; however, the use of a control valve (see FIG. 10) is believed to represent the preferred arrangement.

Figure 5:
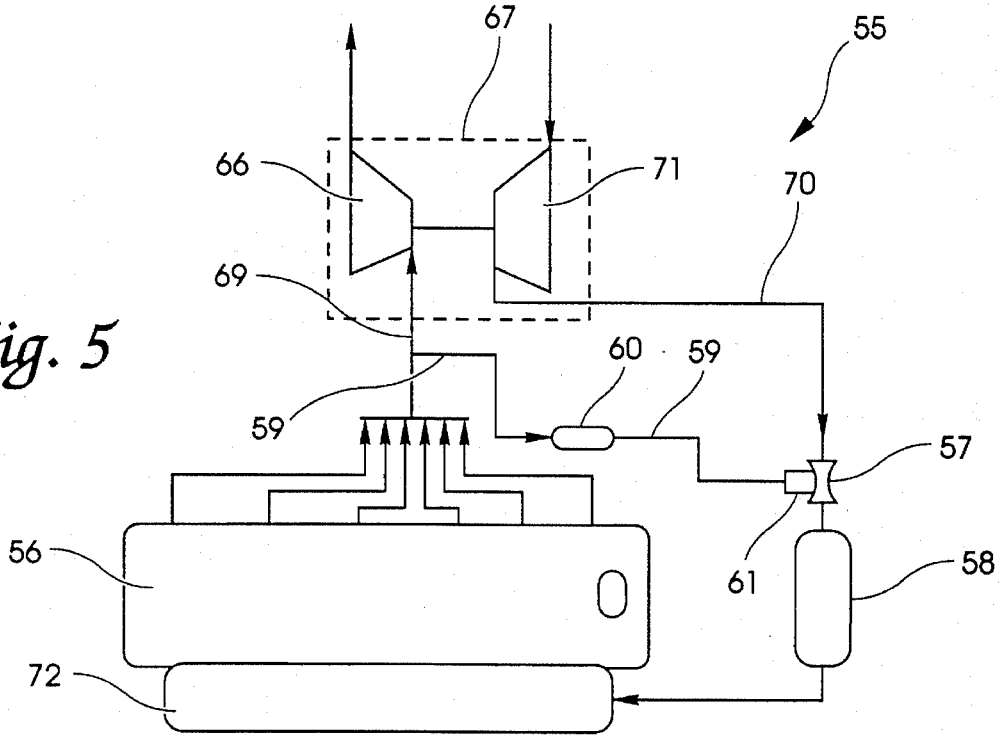
FIG. 5 is a schematic illustration of a turbocharged diesel engine assembly with a venturi conduit in the air flow path according to a typical embodiment of the present invention.

Referring to FIG. 5 there is illustrated a schematic representation of an alternative EGR system 55 for a highly turbocharged diesel engine 56 according to the present invention. EGR system 55 is configured in several respects in a manner similar to flow networks 10 and 20. The most notable differences are the positioning of the venturi conduit 57 upstream of the aftercooler 58 and the addition of flow line 59 and filter 60. Control valve 61 is attached directly to the throat of the venturi conduit 57. The cylinder exhaust from engine 56 (exhaust manifold) flows into the turbine 66 of turbocharger 67. Flow line 59 is a branch line off of flow line 69 and intersects flow line 69 upstream of the turbocharger 67. Flow line 59 routes exhaust gas first through filter 60 and then through control valve 61 and finally to venturi 57. Although flow line 59 is in fact arranged in two sections, the same reference number has been venturi 57. Flow line 70 from compressor 71 carries compressed air (fresh charge air)to venturi 57. The output side of venturi 57 flows into aftercooler 58 and from there to intake manifold 72.

By using a venturi 57 (with either a fixed or variable throat area) downstream of the compressor 71, static pressure at the throat can be sufficiently low to induce the flow of exhaust gas. Venturi 57 may be made of aluminum or other low cost material because it is not subject to high mechanical loading unlike the compressor wheel. By using a small filter 60 which can be either self-regenerating at high loads or electrically regenerated, fouling of the aftercooler 58 can be eliminated. In the case of fairly clean exhaust gas, the filter 60 can be omitted. This system also allows for only one heat exchanger of the intake air instead of having another small heat exchanger in the EGR loop. Cooled EGR helps maintain a higher air/fuel ratio so that with the introduction of exhaust gas into the fresh charge air there is no increase or only a very small increase in particulate, thus resulting in better $NO_x$—particulate trade-off than without cooled EGR.

In order to control when EGR is introduced into the fresh charge air there is a control valve 61. This valve can be solenoid operated and controlled by the central electronic control unit (ECU), thus providing EGR as a function of speed and load. If the engine does not have an electronic fuel injection system, it would be quite expensive to have an ECU and appropriate sensors just for control of EGR. In this case by providing a simple spring biased control valve (see FIGS. 6 and 7) the exhaust gas flows into the fresh charge air, via venturi 57, at and above a predetermined pressure in the exhaust manifold.

Figure 6:
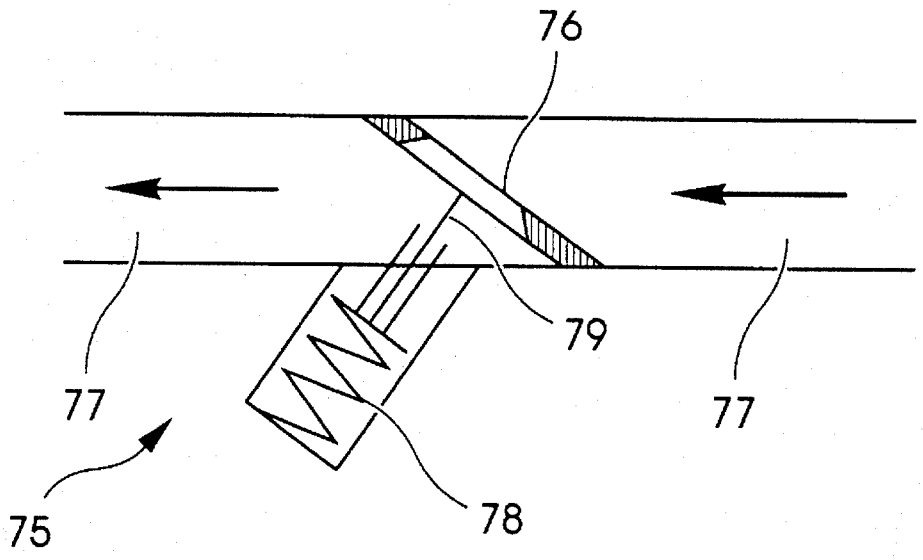
FIG. 6 is a diagrammatic illustration of a control valve which is suitable for use in the flow path of the FIG. 5 assembly.

Referring more specifically to the control valve 75 of FIG. 6, a closing flap or plate 76 is placed at an angle and hinged within the flow line 77. The flow line 77 which receives control valve 75 is effectively the same as flow line 59. As such flow line 77 extends from the exhaust manifold of engine 56 to venturi 57. Plate 76 is spring biased by means of spring 78 and piston 79. Whenever the line pressure of the exhaust gas from the exhaust manifold is sufficient to overcome the predetermined spring force, exhaust gas is allowed to flow into the fresh charge air from the turbocharger 67 via the venturi 57. In effect a predetermined pressure in the exhaust manifold is selected as the threshold for the introduction of exhaust gas into the venturi and the spring bias is set accordingly.

As stated, the venturi style of venturi 57 as used in system 55 may have a fixed or variable throat area and otherwise be of conventional construction as would be known to a person of ordinary skill in the art. It is also an option to replace venturi 57 with either of the venturi styles or arrangements of FIGS. 3 and 4. While the small pipe arrangement of FIG. 4 is not shaped as a narrow throated venturi conduit or nozzle, there is a pressure difference which influences the flow of exhaust (or blow-by) gas into the primary flow of fresh charge air.

Figure 7:
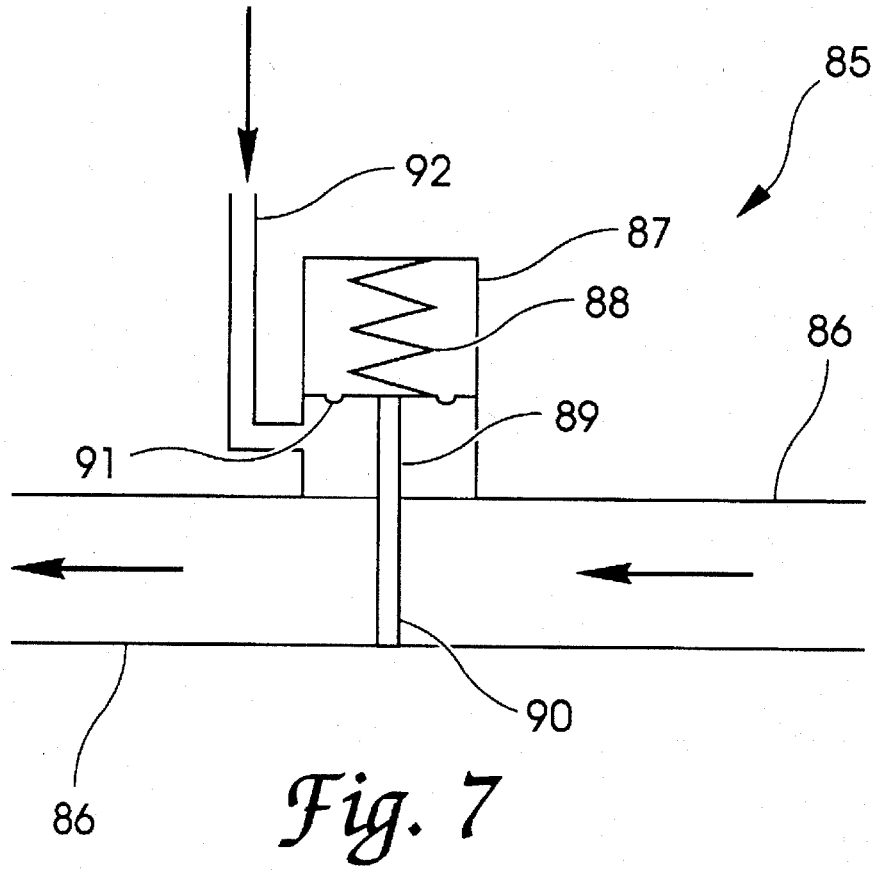
FIG. 7 is a diagrammatic illustration of a control valve design which is suitable for use in the FIG. 5 assembly.

Referring to FIG. 7 an alternative embodiment of a suitable control valve is illustrated. Control valve 85 is positioned above flow line 86 (same as flow lines 59 and 77) which extends from the exhaust manifold of engine 56 to venturi 57. An enclosed spring chamber 87 receives a bias spring 88 which acts on a diaphragm piston 89 having as a piston arm a connected flow-blocking plate 90 that extends into and across flow line 86. Plate 90 is sized and shaped to block the flow of exhaust gas unless a sufficient boost pressure is seen by diaphragm 91. By means of conduit 92 the intake manifold boost pressure acts on diaphragm 91.

Similar in concept to control valve 75, the spring biasing force is predetermined at a level which correlates to a predetermined boost pressure. When that pressure is exceeded the spring force is overcome and the diaphragm pushed upwardly, lifting plate 90 which in turn enables some flow through flow line 86. The greater the boost pressure over the threshold level, the more compression of bias spring 88 and the more flow clearance which is provided in flow line 86.

As already briefly mentioned exhaust gas recirculation (EGR) is proposed as a means of reducing $NO_x$ in medium and heavy duty turbocharged diesel engines. The exhaust gas will flow from the exhaust side to intake side through a simple tube if the exhaust side pressure is greater than the intake side pressure. However, in many engine operating conditions the intake side pressure is either about the same as the exhaust-side pressure or greater than the exhaust-side pressure. The intake side static pressure can be reduced by accelerating the intake-side flow through a venturi. Connecting the EGR tube to the venturi throat will increase the pressure differential from the exhaust to intake side which will enhance the EGR flow rates and increase the number of engine operating conditions where EGR is possible. This is basically tile technical foundation or theory as embodied by systems 10 and 55 and the designs of venturi 19 and 57 (and the venturi design variations of FIGS. 3 and 4) and control valves 75 and 85.

If the operation of the control valve is controlled solely by throttle position, a suitable control system (EGR control algorithm) will be provided for directing the operation of the control valve. In one possible arrangement, the output of a throttle position sensor (TPS) is used as an input to two parallel filters where the TPS outputs a voltage proportional to rack position. The first filter is a lag-lead compensated filter which functions as a differentiator, producing an output proportional Lo the instantaneous rate of change of the throttle position. The second filter is a fixed-rate tracking filter which generates a tracking signal that tracks the input signal. The tracking signal, however, cannot vary by more than a maximum predetermined rate. The output of the second filter is the difference between the input signal and the tracking signal. The outputs of the two filters are summed and applied to a hysteretic comparator, which turns the EGR control valve off (closed) when the sum exceeds an upper threshold and turns the EGR control valve back on (open) when the sum has decayed below a lower threshold. If the TPS rate of change is above a certain threshold value, transient response and acceleration smoke will be unacceptable with EGR on due to air-limited operation. Therefore, above that value the EGR valve will be closed. The algorithm also determines when to open the EGR valve after it has been closed by a sudden up-fueling to obtain maximum $NO_x$ benefit without a particulate/smoke penalty. the EGR valve is also closed at full throttle (determined by the TPS position) for maximum engine power output. Accordingly, the first filter output is largely responsible for triggering the EGR valve to turn off, while the second filter output is responsible for determining how long the EGR valve remains off.

An alternative control system design which is suitable for the present invention would include a first signal processor which is operable to produce a first output signal based upon a rate of change of an input signal and a second signal processor operable to produce a second output signal which tracks the input signal over time. The second signal processor output signal does not exceed a predetermined maximum rate of change and the system output signal comprises a summation of the first signal processor output signal and the second signal output signal.

Another option for a suitable control system includes an input port adapted to receive an input signal indicative of an engine operating parameter. There is a first signal processor operatively coupled to the input port which is operable to produce a first signal processor output signal based upon a rate of change of the input signal. A second signal processor which is operable to produce a second signal processor output signal tracks the input signal over time. The second signal processor output signal does not exceed a predetermined maximum rate of change. An output port is operatively coupled to the first and second signal processors and to the EGR control valve. The system output signal comprises a summation of the first signal processor output signal and the second signal processor output signal.

Figure 8:
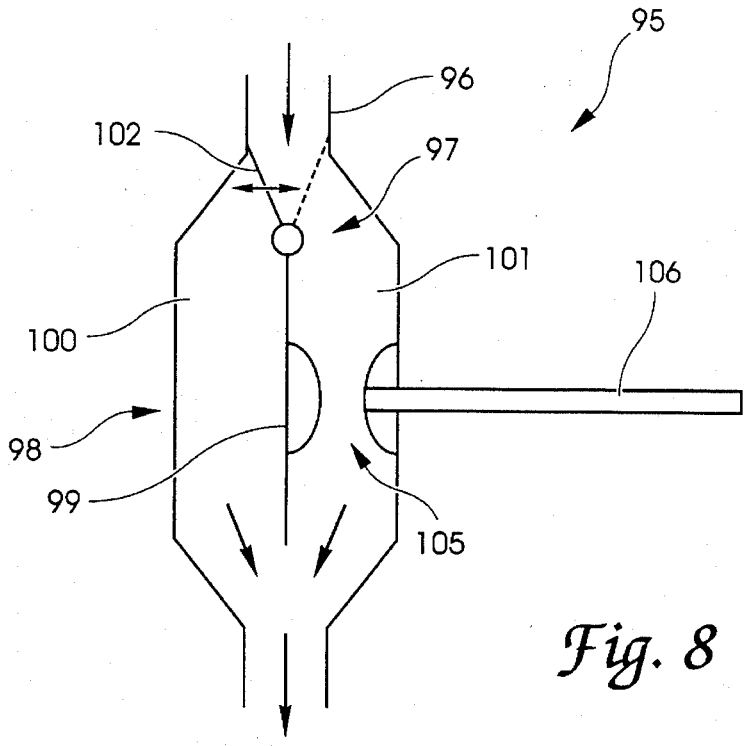
FIG. 8 is a diagrammatic illustration of a variable flow rate venturi which may be used with any of the FIG. 1, FIG. 2 or FIG. 5 assemblies.
Figure 9:
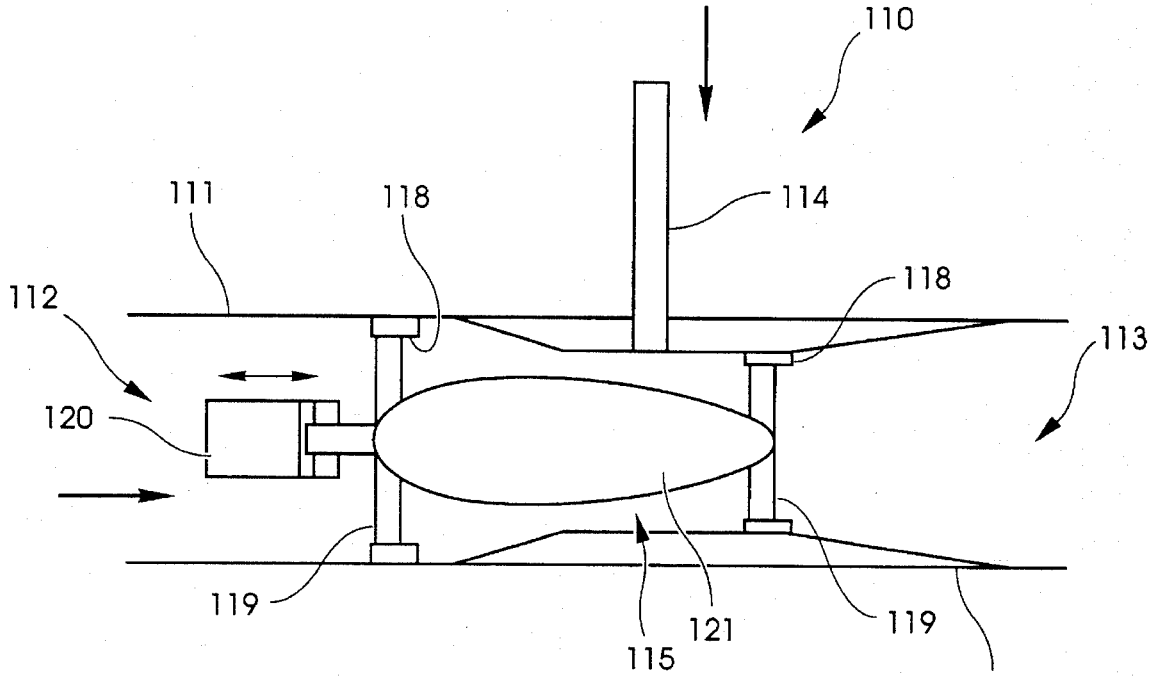
FIG. 9 is a diagrammatic illustration of a variable throat area venturi which is suitable for use with any of the FIG. 1, FIG. 2 or FIG. 5 assemblies.

Referring now to FIGS. 8 and 9 two further venturi designs which are suitable for use with the present invention are illustrated. Each of these designs provide control over the EGR flow rate by controlling the pressure at the venturi throat.

Referring first to FIG. 8, venturi 95 is a variable mass flow or flow rate venturi. Venturi 95 is to be positioned similar to venturi 57 (see FIG. 5) downstream from the compressor and upstream from the aftercooler. Inlet 96 receives the fresh charge air from the compressor and this incoming flow is directed by a controllable diverter valve 97. Flow chamber 98 is separated by partition 99 into a by-pass path 100 and a venturi path 101. When the closing flap 102 of diverter valve 97 is moved all the way to the right (broken line position) the venturi path 101 is completely closed off from the incoming fresh charge air which flows through the by-pass path 100 to the aftercooler without the introduction of any EGR.

When closing flap 102 is positioned all the way to the left so as to close off the by-pass path 100, the venturi path 101 is opened. As fresh charge air flows through the venturi path, the narrow throat 105 creates a venturi effect on the EGR which is present within flow line 106 coming from the exhaust manifold.

As will be appreciated, the controllable diverter valve 97 is capable of being positioned at virtually any point in between the two extremes of all of the way to the left or all the way to the right. When the closing flap 102 of the diverter valve is positioned between the end point extremes it will adjust or proportion the flow between the two flow paths 100 and 101. The static pressure at the venturi throat and thus the differential pressure is set by controlling the mass flow through the venturi flow path. The throat section of the venturi is sized to provide controllable EGR over the entire engine map.

Referring to FIG. 9 a variable area of venturi design is illustrated. Venturi arrangement 110 is positioned in a flow line 111 with an intake side 112 and an exit flow side 113. The EGR flow line 114 intersects the flow line 111 as illustrated. Tile point of intersection is at a narrowed portion 115 of flow line 111; the narrowing being achieved by the placement of a narrowing sleeve in the flow line 111. The remainder of venturi arrangement 110 includes guide rings 118, struts 119, actuator 120 and centerbody 121.

Centerbody 121 which is aerodynamically smooth is positioned within the slight area reduction section (portion 115) and is moveable axially relative to the area reduction section. The static pressure at the venturi throat is controlled by changing the venturi area via tile centerbody position. The centerbody 121 is held by struts 119 to guide rings 118 which keep the centerbody in the center of the tube. The rear guide ring is used as a shut-off valve. The controlling actuator is located in the clean, up stream air.

The venturi arrangements of FIG. 8 and 9 are suitable for use as the venturi of the FIG. 1 flow network 10 or the FIG. 2 flow network 20 or the FIG. 5 flow system 55.

Figure 10:
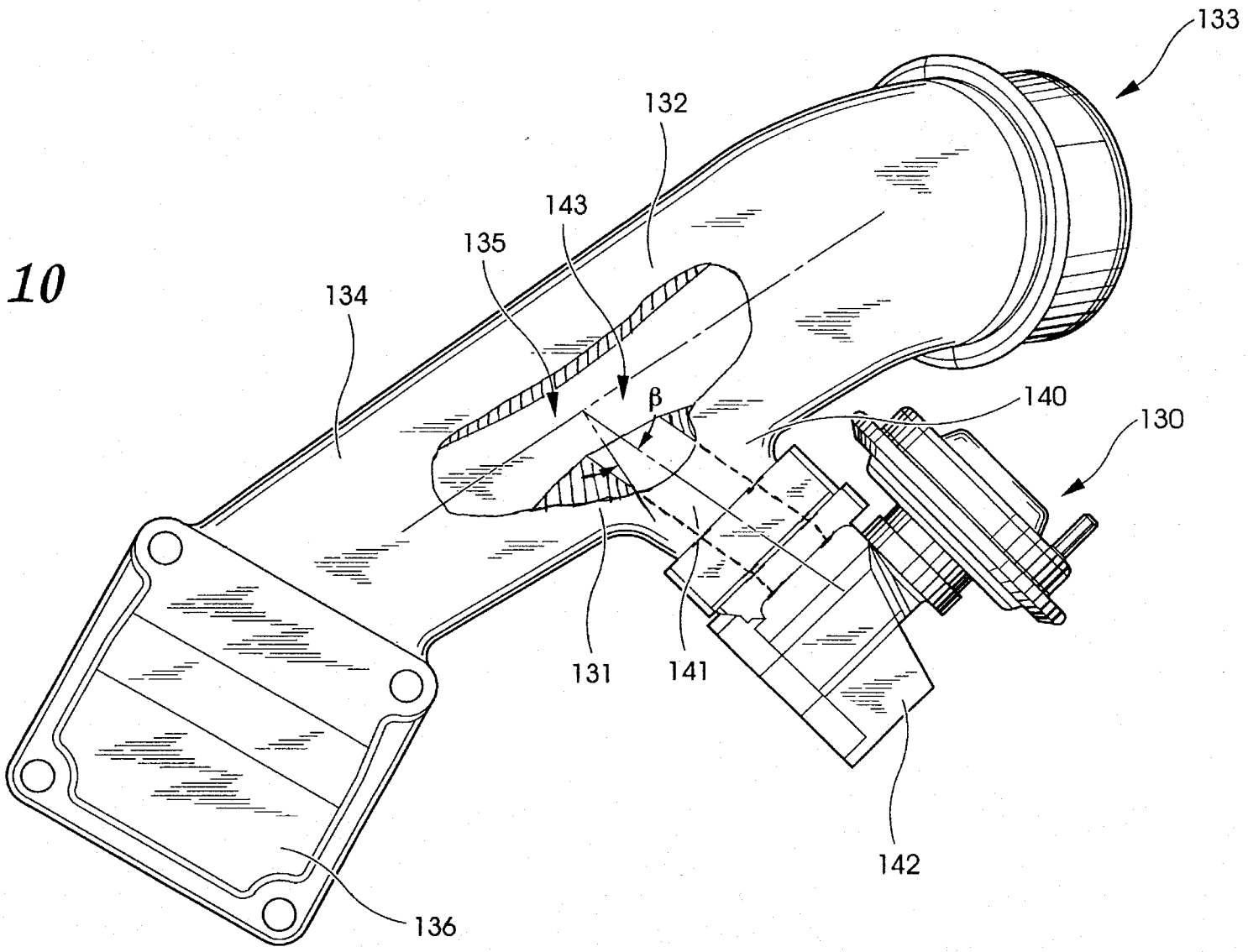
FIG. 10 is a perspective view of an EGR control valve as mounted to a venturi conduit according to the present invention.

Referring to FIG. 10 a representative control valve 130 is illustrated as attached directly to the throat area 131 of a venturi conduit 132. The FIG. 10 illustrated combination is suitable for use in any of the FIG. 1, 2, or 5 arrangements for handling either EGR or blow-by gas. Venturi conduit 132 has an air flow inlet end 133 and an elongated body 134. Contoured on the interior of tile elongated body is a venturi 135. The outlet end 136 is designed so as to be attachable directly to the intake manifold.

The control valve 130 mounts to a raised portion 140 of the elongated body 134 and a flow passageway 141 is defined by this raised portion 140 and is in direct flow communication with the control valve. The control valve has an inlet port 142 which receives a flow of EGR or blow-by gas. Whether this flow of gas actually enters tile venturi is controlled by the opened or closed state of the control valve based on a selected valve control system. The gas which is allowed to flow passes through passageway 141 and from there into the throat 143 of the venturi. The gas is actually introduced at an acute angle (β) into the venturi throat 143 and this provides a desireable balance between mixing of the gas flow and fresh charge air and the gas flow rate with a minimal effect on the pressure drop across the venturi.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In combination:

a turbocharged diesel engine assembly including a diesel engine, a turbocharger, an engine gas flow line from said diesel engine for routing engine gas out of said diesel engine, and a fresh charge air flow line from said turbocharger to said diesel engine so as to deliver fresh charge air from said turbocharger to said diesel engine;

a venturi conduit placed in said fresh charge air flow line between said turbocharger and said engine, said venturi conduit having a throat area and defining a flow path therethrough for said fresh charge air; and a control valve attached to said throat area and having a passageway therethrough and being disposed in flow communication with the flow path through said venturi conduit, said passageway intersecting said flow path at a location which coincides with said throat area, said passageway being connected in flow communication with said engine gas flow line whereby engine gas exiting from said diesel engine and flowing through said engine gas flow line is able to be blended with fresh charge air due to a low static pressure created by said venturi, the introduction of engine gas into said venturi conduit being controlled by said control valve.

2. The combination of claim 1 wherein said turbocharged diesel engine assembly includes an aftercooler in said fresh charge air flow line.

3. The combination of claim 2 wherein said venturi is placed downstream of said aftercooler between said aftercooler and said engine.

4. The combination of claim 2 wherein said venturi is placed upstream of said aftercooler between said aftercooler and said turbocharger.

5. The combination of claim 4 wherein said turbocharged diesel engine assembly includes a filter in said engine gas flow line upstream of said venturi.

6. The combination of claim 1 wherein said control valve is set at an acute angle relative to said venturi conduit such that in operation with a flow of engine gas through said passageway and a flow of fresh charge air through said venturi conduit, the engine gas enters the flow of fresh charge air at an acute angle.

* * * * *

UNITED STATES PATENT AND TRADEMARK OFFICE
CERTIFICATE OF CORRECTION

PATENT NO. : 5,611,204

DATED : March 18, 1997

INVENTOR(S) : Rod Radovanovic, et al.

It is certified that error appears in the above-identified patent and that said Letters Patent is hereby corrected as shown below:

On the title page,

In item [57] (Abstract), the 6th line thereof, replace "tile" with --the--.

In Col. 1, line 37, replace "tile" with --the--.

In Col. 1, lines 56-57, delete "temperature causes an increase in the amount of $NO_x$ present".

In Col. 1, line 59, after "combustion", insert ---temperature causes an increase in the amount of $NO_x$ present--.

In Col. 2, line 50, replace "tile" with --the--.

In Col. 2, line 62, replace "tile" with --the--:

In Col. 3, line 8, replace "tile" with --the--.

In Col. 4, line 47, replace "tile" with --the--.

In Col. 7, line 60, replace "tile" with --the--.

In Col. 8, line 5, replace "Lo" with --to--.

In Col. 9, line 25, replace "Tile" with --The--.

In Col. 9, line 34, replace "tile" with --the--.

In Col. 9, line 48, replace "tile" with --the--.

In Col. 9, line 56, replace "tile" with --the--.

Signed and Sealed this

First Day of July, 1997

Bruce Lehman

*Attest:*

*Attesting Officer*

BRUCE LEHMAN

*Commissioner of Patents and Trademarks*